US009561412B2

(12) United States Patent
Ueda

(10) Patent No.: US 9,561,412 B2
(45) Date of Patent: Feb. 7, 2017

(54) IRON-TYPE GOLF CLUB HEAD

(71) Applicant: Dunlop Sports Co. Ltd., Kobe-shi, Hyogo (JP)

(72) Inventor: Naoyoshi Ueda, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 257 days.

(21) Appl. No.: 14/335,968

(22) Filed: Jul. 21, 2014

(65) Prior Publication Data

US 2015/0051013 A1 Feb. 19, 2015

(30) Foreign Application Priority Data

Aug. 13, 2013 (JP) ..... 2013-168031

(51) Int. Cl.
*A63B 53/04* (2015.01)

(52) U.S. Cl.
CPC ..... *A63B 53/047* (2013.01); *A63B 60/54* (2015.10); *A63B 2053/042* (2013.01); *A63B 2053/0408* (2013.01); *A63B 2053/0416* (2013.01); *A63B 2053/0429* (2013.01); *A63B 2053/0458* (2013.01)

(58) Field of Classification Search
USPC ..... 473/324–350
See application file for complete search history.

(56) References Cited

U.S. PATENT DOCUMENTS 4,749,197 A * 6/1988 Orlowski ..... A63B 53/04 473/342
5,261,663 A * 11/1993 Anderson ..... A63B 53/04 473/342
5,344,140 A * 9/1994 Anderson ..... A63B 53/04 473/342
5,447,307 A * 9/1995 Antonious ..... A63B 53/02 473/350
5,707,302 A * 1/1998 Leon ..... A63B 53/04 473/324
5,823,887 A * 10/1998 Mikame ..... A63B 53/04 473/290

(Continued)

FOREIGN PATENT DOCUMENTS

JP 09192270 A * 7/1997
JP 2000126340 A * 5/2000

(Continued)

*Primary Examiner* — Alvin Hunter
(74) *Attorney, Agent, or Firm* — Birch, Stewart, Kolasch & Birch, LLP

(57) ABSTRACT

An iron-type golf club head comprises a head main body and a face plate attached thereto. The face plate has an annular outer edge portion fixed to the head main body, and a noncontact portion not contacting with the head main body. The noncontact portion includes a first thin part and a second thin part having a thickness less than that of the outer edge portion. The first thin part extends in a peripheral side along the upper edge, the toe-side edge and the lower edge of the face plate. The second thin part is formed to have a thickness less than that of the first thin part. The area of the first thin part is 10% to 35% of the area of the noncontact portion. The area of the second thin part is 65% to 90% of the area of the noncontact portion.

9 Claims, 11 Drawing Sheets

(56) References Cited

U.S. PATENT DOCUMENTS

| | | | | | |
|---|---|---|---|---|---|
| 5,873,795 | A * | 2/1999 | Wozny | A63B 53/04 | 473/346 |
| 6,379,262 | B1 * | 4/2002 | Boone | A63B 53/04 | 473/324 |
| 7,144,337 | B2 * | 12/2006 | Hirano | A63B 53/047 | 473/329 |
| 7,235,023 | B2 * | 6/2007 | Sugimoto | A63B 53/047 | 473/291 |
| 7,364,513 | B2 * | 4/2008 | Krumme | A63B 53/047 | 473/329 |
| 7,544,136 | B2 * | 6/2009 | Tsai | A63B 53/047 | 473/342 |
| 7,892,106 | B2 * | 2/2011 | Matsunaga | A63B 53/047 | 473/290 |
| 2006/0116219 | A1 | 6/2006 | Hirano | | |

FOREIGN PATENT DOCUMENTS

| | | | | |
|---|---|---|---|---|
| JP | 2001029523 | A | * | 2/2001 |
| JP | 2001293113 | A | * | 10/2001 |
| JP | 2002000777 | A | * | 1/2002 |
| JP | 2003245384 | A | * | 9/2003 |
| JP | 2004187710 | A | * | 7/2004 |
| JP | 2006-149964 | A | | 6/2006 |
| JP | 2009240365 | A | * | 10/2009 |
| JP | 2012-166093 | A | | 9/2012 |
| JP | 2013-59680 | A | | 4/2013 |

* cited by examiner

IRON-TYPE GOLF CLUB HEAD

BACKGROUND OF THE INVENTION

The present invention relates to an iron-type golf club head having high rebound performance.

Japanese Patent Application Publication Nos. 2012-166093, 2013-59680 and 2006-149964 each disclose an iron-type golf club head comprising a head main body and a face plate only a periphery zone of which is supported by the head main body.

SUMMARY OF THE INVENTION

It is an object of the present invention to provide an iron-type golf club head in which the rebound performance is improved without sacrificing the durability.

According to the present invention, an iron-type golf club head comprises a head main body having a top, a sole and a toe surface extending therebetween, and a face plate attached to the head main body and having a front surface for hitting a ball, the face plate defined by its circumferential surface composed of an upper edge extending on the top side, a lower edge extending along the sole, a toe-side edge extending along the toe surface, and a heel-side edge on the opposite side of the toe-side edge, the face plate comprising an annular outer edge portion fixed to the head main body, and a noncontact portion surrounded by the annular outer edge portion and not contacting with the head main body, the noncontact portion comprising a first thin part having a thickness less than that of the annular outer edge portion, and a second thin part having a thickness less than that of the first thin part, the first thin part formed in a peripheral side of the noncontact portion so as to extend along at least the upper edge, the toe-side edge and the lower edge of the circumferential surface of the face plate, wherein the area of the first thin part is 10% to 35% of the area of the noncontact portion, and the second thin part formed on the inner side of the first thin part, wherein the area of the second thin part is 65% to 90% of the area of the noncontact portion.

The iron-type golf club head according to the present invention may have the following features (1)-(9):

(1) the thickness of the first thin part is 1.8 to 3.0 mm, and the thickness of the second thin part is 1.4 to 2.6 mm;

(2) the area of the first thin part is 15% to 30% of the area of the noncontact portion, and the area of the second thin part is 70% to 85% of the area of the noncontact portion;

(3) the thickness of the first thin part is 2.0 to 2.8 mm, and the thickness of the second thin part is 1.6 to 2.4 mm;

(4) the first thin part includes a sole-side first thin part extending along the above-mentioned lower edge, and the sole-side first thin part comprises a toe-side region, a heel-side region and a middle region therebetween such that the width of the middle region is more than the width of the toe-side region and more than the width of the heel-side region, each width measured perpendicularly to the longitudinal direction of the lower edge;

(5) the above-mentioned middle region of the sole-side first thin part is disposed in a region ranging 20 mm from the sweet spot of the face toward the toe-side and also toward the heel-side;

(6) the width of the middle region is 3 to 13 mm, the width of the toe-side region is 1 to 10 mm, the width of the heel-side region is 1 to 10 mm, the difference between the width of the middle region and the width of the toe-side region is not less than 2 mm, and the difference between the width of the middle region and the width of the heel-side region is not less than 2 mm;

(7) the face plate is provided in the second thin part with a badge made of a thin plate and fixed to the back surface of the face plate, and the area of the badge is not more than 93% of the area of the second thin part;

(8) the badge is made of a metal sheet having a thickness of 0.1 to 0.8 mm;

(9) the second thin part is composed of a reinforced region to which the badge is attached, and a non-reinforced region to which the badge is not attached and which is positioned on the sole-side of the reinforced region, and the size of the non-reinforced region measured in the up-down direction becomes larger on the toe-side and the heel-side of a central portion of the non-reinforced region in the toe-heel direction than in the central portion.

Therefore, the iron-type golf club head according to the present invention can be improved in the rebound performance while maintaining the durability.

In this application including the description and claims, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the specified lie angle alpha while keeping the axis on a vertical plane, and the face forms the specified loft angle with respect to the horizontal plane HP. Incidentally, in the case of the club head alone, the center line CL of the shaft inserting hole can be used instead of the axis of the club shaft.

"Front-back direction" is a direction parallel with a straight line projected on the horizontal plane HP, wherein the straight line is drawn normally to the face passing through the center G of gravity of the club head.

"Toe-heel direction" is a direction parallel with the horizontal plane HP and perpendicular to the front-back direction.

"Sweet spot SS" is the point of intersection between the face F and a straight line drawn normally to the face F passing the center of gravity G of the head.

DESCRIPTION OF THE PREFERRED EMBODIMENTS

Figure 1:
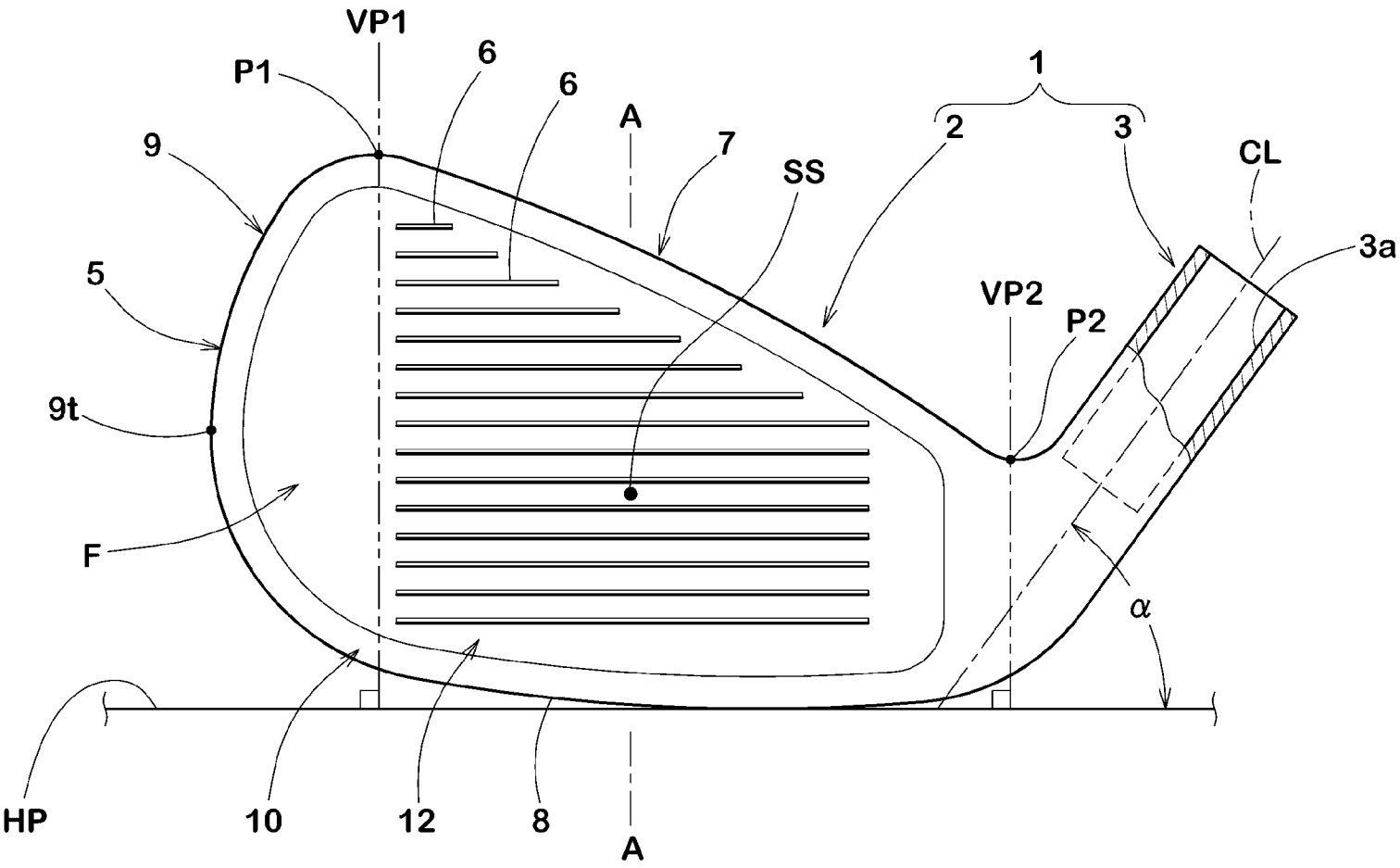
FIG. 1 is a front view of an iron-type golf club head as a first embodiment of the present invention under its standard state.

Embodiments of present invention will now be described in detail in conjunction with the accompanying drawings.

The present invention may be applied to an iron-type golf club head regardless of the lie angle alpha and the loft angle beta.

Typically and in the following embodiments, the lie angle alpha is in a range of from 50 to 70 degrees, and the loft angle beta is in a range of from 15 to 70 degrees.

In the drawings, iron-type club head 1 according to the present invention comprises a club head main body 2 and a hosel 3.

The club head main body 2 is defined by a face F, a back side 4, and a circumferential surface 5.

The face F is a surface for hitting a ball.

The face F is a single part formed by a surface which is substantially flat excepting impact area markings 6 if any. As for an impact area marking 6, typical, a groove is used, but a punch mark or the like may be used too.

Figure 2:
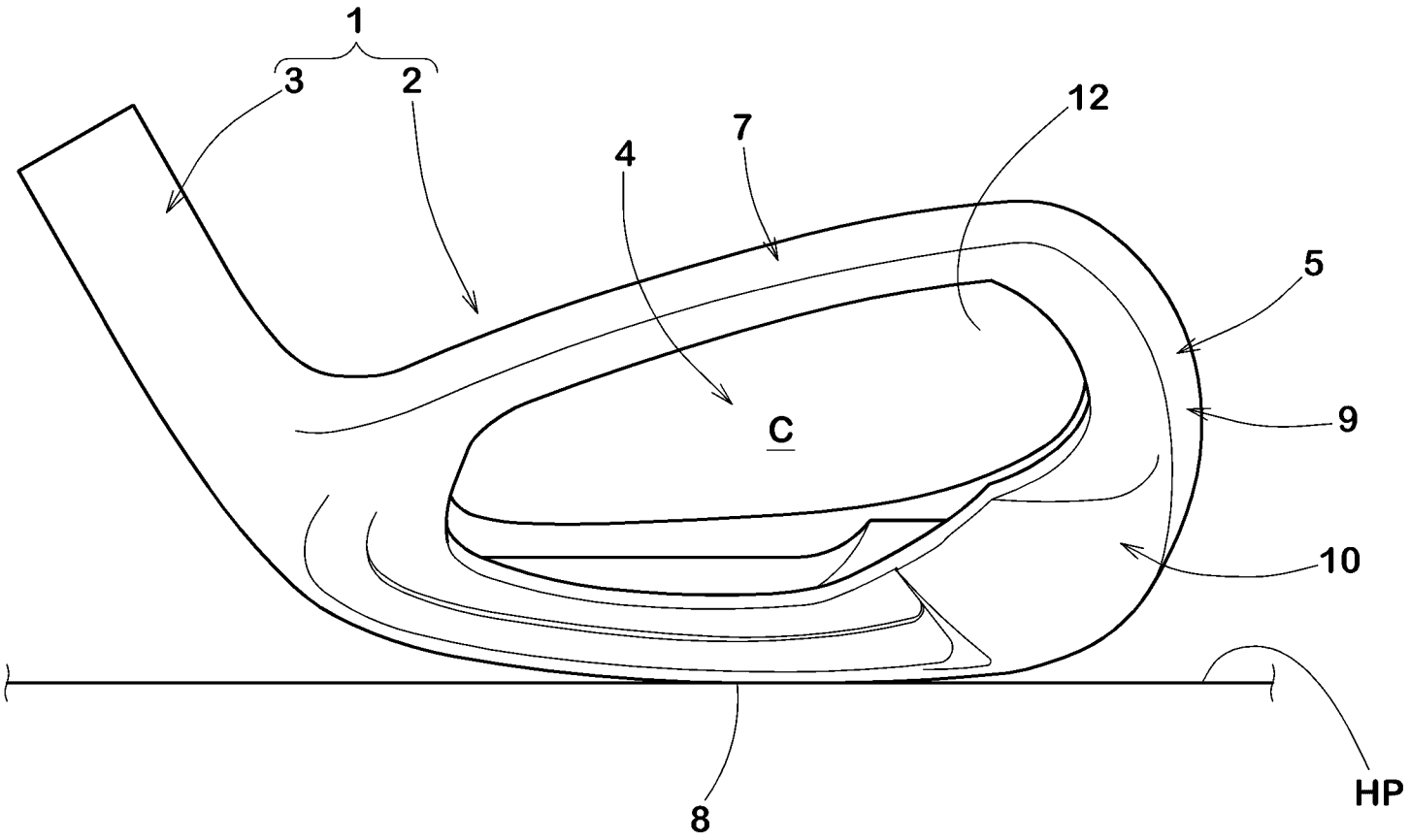
FIG. 2 is a rear view of the golf club head shown in FIG. 1.

The back side 4 is a surface on the opposite side of the face F. In this embodiment, as shown in FIG. 2, a cavity C is formed in the back side 4.

The circumferential surface 5 extends between the face F and the back side 4. The circumferential surface 5 includes a top 7, the sole 8 and a toe surface 9 as shown in FIGS. 1 and 2.

The top 7 is a surface extending backwardly of the club head from the upper edge of the face F to form the upper surface of the club head.

The sole 8 is a surface extending backwardly of the club head from the lower edge of the face F to form the bottom surface of the club head.

The toe surface 9 extends between the top 7 and the sole 8. The toe surface 9 includes a toe-side end 9*t* which is a toe-side extreme end of the head in the toe-heel direction.

The upper edge of the face F has
a toe-side high point P1 which is the uppermost point and
a heel-side low point P2 which is the lowermost point.

The top 7 is a part of the circumferential surface 5 defined as extending, on the upper side of the club head, between a vertical plane VP1 on the toe-side and a vertical plane VP2 on the heel-side.

Here, the vertical plane VP1 is defined as including the toe-side high point P1 and being perpendicular to the face F.

The vertical plane VP2 is defined as including the heel-side low point P2 and being perpendicular to the face F.

The sole 8 is a part of the circumferential surface 5 defined as extending, on the under side of the club head, between the vertical plane VP1 on the toe-side and the vertical plane VP2 on the heel-side.

The hosel 3 is a upwardly protruding tubular portion. The hosel 3 is formed in a heel-side of the club head main body 2. The hosel 3 is provided with a bottomed shaft inserting hole 3*a* into which a shaft (not shown) is inserted.

The club head 1 includes, as its constructional members, a head main body 10 and a face plate 12.

Figure 3:
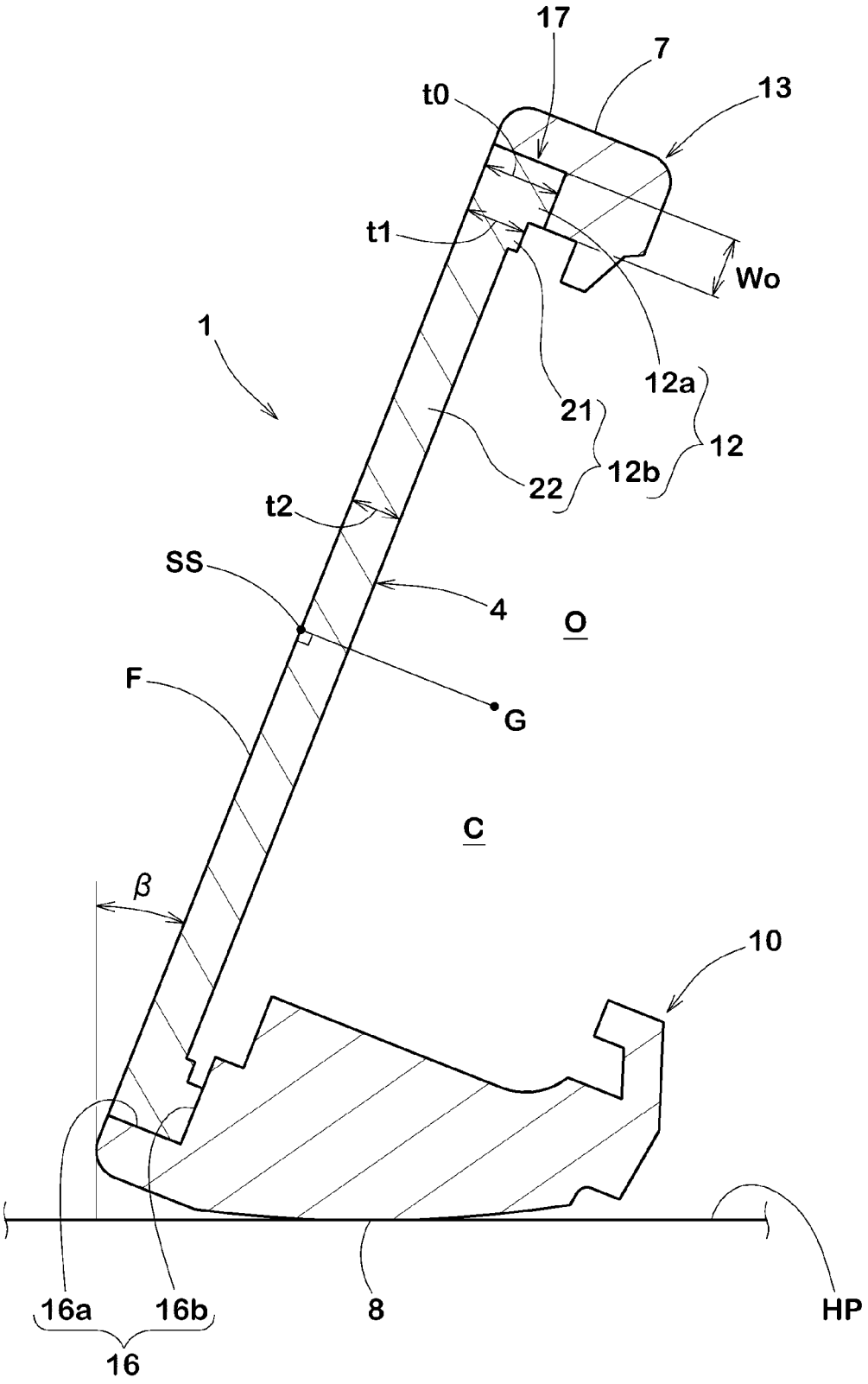
FIG. 3 is a cross sectional view taken along line A-A of FIG. 1.
Figure 4:
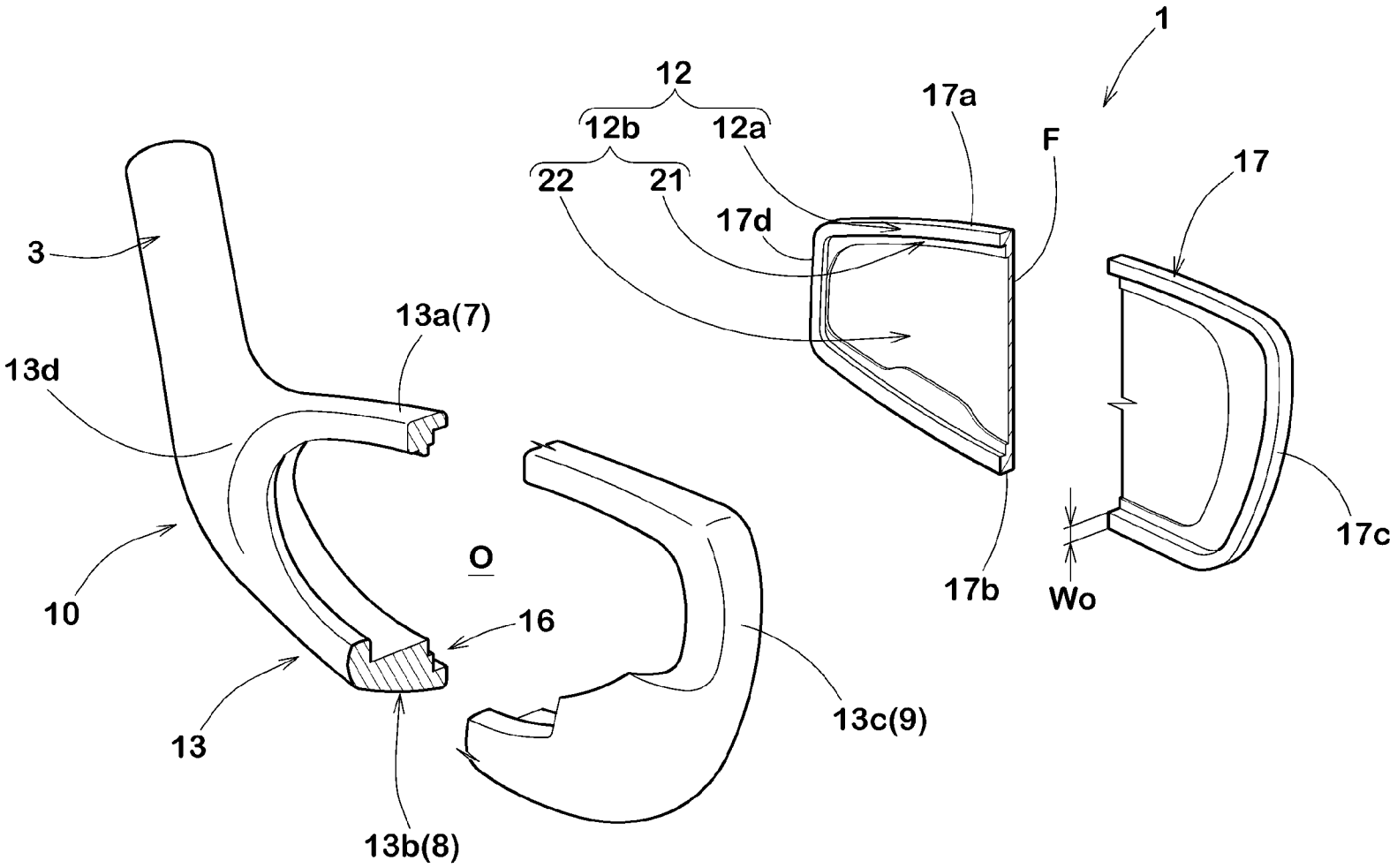
FIG. 4 is an exploded perspective view of the golf club head shown in FIG. 1.

The front surface of the face plate 12 forms at least a part, preferably, a major part of the face F as shown in FIGS. 3 and 4.

The face plate 12 has a surrounding circumferential surface 17. The circumferential surface 17 is made up of
an upper edge 17*a* extending on the top 7 side,
a lower edge 17*b* extending along the sole 8,
a toe-side edge 17*c* extending along the toe surface 9, and
a heel-side edge 17*d* on the opposite side of the toe-side edge 17*c*.

As to the material of the face plate 12, metal materials, especially those having a high specific strength such as titanium alloys can be suitably used. As to the titanium alloys, for example, Ti-5Al-1Fe is preferably used.

The head main body 10 includes the hosel 3 and a face-receiving part 13.

For the head main body 10, one kind or more kinds of materials selected from stainless steels, maraging steels, Ni-based alloys and soft iron can be suitably used.

It is also possible that the head main body 10 is provided with a weight member (not shown) made of a metal material having a relatively high specific gravity.

The face-receiving part 13 extends circularly around an opening O penetrating through the head main body 10 in the front-back direction.

The face-receiving part 13 is made up of a top frame 13*a*, a sole frame 13*b*, a toe frame 13*c* and a heel frame 13*d*.

The top frame 13*a* defines the top 7.

The sole frame 13*b* defines the sole 8.

The toe frame 13*c* extends, on the toe-side, between the top frame 13*a* and the sole frame 13*b* to define the toe surface 9.

The heel frame 13*d* extends, on the heel-side, between the top frame 13*a* and the sole frame 13*b*. The heel frame 13*d* is formed integrally with the above-mentioned hosel 3.

The face-receiving part 13 is, as shown in FIG. 3, provided in the front thereof with a face mounting portion 16 to which the face plate 12 is mounted.

The face mounting portion 16 is formed circularly surrounding the opening O.

The face mounting portion 16 is a stepped hole having an inner circumferential surface 16*a* facing toward the center of the club head and a step surface 16*b* facing frontward.

The face plate 12 is fitted in the face mounting portion 16 so that the outer circumferential surface 17 of the face plate 12 abuts on the inner circumferential surface 16*a*, and the back surface of the face plate 12 abuts on the step surface 16*b*.

The face plate 12 and the face mounting portion 16 are fixed to each other by fixing means for example adhesive bonding, press fitting, caulking, welding, screw fastening and/or the like.

By attaching the face plate 12 to the face mounting portion 16, the opening O is closed thereby, and
an open cavity C is formed on the back side of the face plate 12.

The face plate 12 has an outer edge portion 12*a* supported by the inner circumferential surface 16*a* and the step surface 16*b* of the head main body 10, and
a noncontact portion 12*b* or portion not supported by the face mounting portion 16.

The outer edge portion 12*a* has a thickness t0 more than that of the noncontact portion 12*b*.

Therefore, the durability of the joining portion of the face plate 12 with the face-receiving part 13 can be improved. Further, the outer edge portion 12*a* can distribute more weight to the periphery of the face F to provide a wide high-restitution-coefficient area.

In order to effectively derive such advantageous effects, the width Wo of the outer edge portion 12*a* is preferably set in a range of not less than 1.5 mm, more preferably not less than 2.0 mm, but not more than 4.5 mm, more preferably not more than 4.0 mm.

Figure 5:
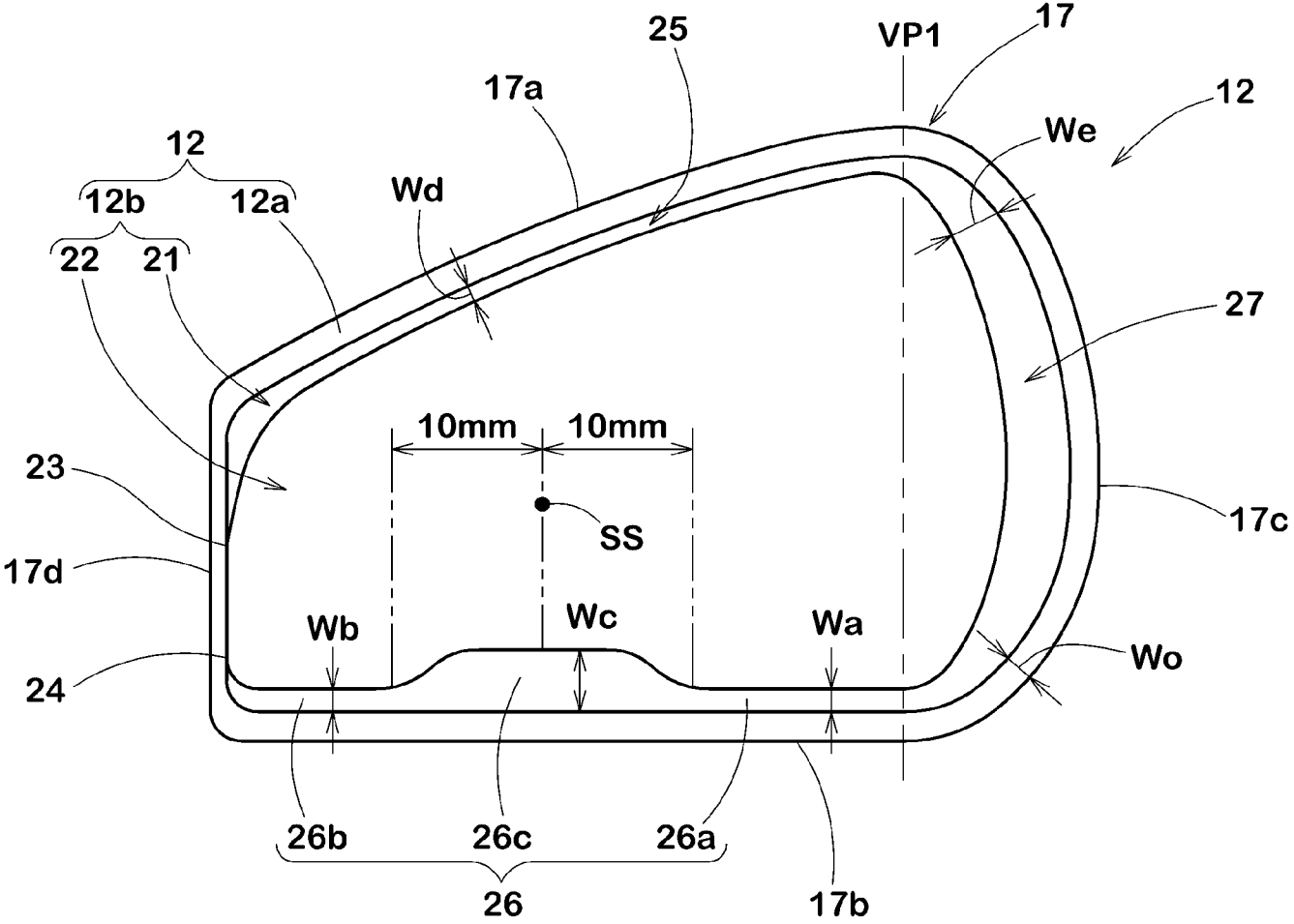
FIG. 5 is a rear view of the face plate in the first embodiment.

Here, the width Wo is measured perpendicularly to the circumferential surface 17 in the back view of the face plate 12 as shown in FIG. 5.

In this embodiment, excepting a part adjacent to the heel-side edge 17*d*, the width Wo of the outer edge portion 12*a* is substantially constant.

The noncontact portion 12*b* of the face plate 12 is, as shown in FIG. 4, surrounded by the outer edge portion 12*a*. The noncontact portion 12*b* is aligned with the opening O of the head main body 10 so that the noncontact portion 12*b* does not contact with the head main body 10 even if the face plate is deflected backward when hitting a ball.

Thus, at the time of hitting a ball, the noncontact portion 12*b* can freely deflect or elastically deform toward the backside of the club head in order to improve the rebound performance.

The noncontact portion 12*b* of the face plate 12 comprises a first thin part 21 having a thickness t1 less than that of the outer edge portion 12*a*, and a second thin part 22 having a thickness t2 less than that of the outer edge portion 12*a*.

In this embodiment, the thickness t1 is contact, and the thickness t2 is also contact.

The face plate 12 is however, not limited to such configuration.

FIG. 5 is a rear view of the face plate 12 in a state where the face F is parallel with the plane of paper.

The first thin part 21 extends along at least the upper edge 17*a*, the lower edge 17*b* and the toe-side edge 17*c* to form a peripheral part of the noncontact portion 12*b*.

That is, the first thin part 21 includes a top-side first thin part 25, a sole-side first thin part 26 and a toe-side first thin part 27 which are defined as follows: the part 25 is continuous with the part 27 at the first vertical plane VP1, and the part 27 is continuous with the part 26 at the first vertical plane VP1.

In this embodiment, the first thin part 21 is discontinuous on the heel-side edge 17*d* side.

The first thin part 21 has an upper end 23 and a lower end 24 in the range of the length of the heel-side edge 17*d*.

The first thin part 21 is formed adjacently to the outer edge portion 12*a*.

The second thin part 22 is formed inside the first thin part 21. In other words, the second thin part 22 is surrounded by the first thin part 21.

The thickness t2 of the second thin part 22 is less than the thickness t1 of the first thin part 21.

In this embodiment, the second thin part 22 abuts on the outer edge portion 12*a* at the heel-side edge 17*d*, otherwise abuts on the first thin part 21.

In the rear view of the face plate 12 taken perpendicularly to the face as shown in FIG. 5, the area A1 of the first thin part 21 is preferably set in a range of not less than 10%, more preferably not less than 15%, but not more than 35%, more preferably not more than 30% of the area A of the noncontact portion 12*b*, and the area A2 of the second thin part 22 is preferably set in a range of not less than 65%, more preferably not less than 70%, but not more than 90%, more preferably not more than 85% of the area A of the noncontact portion 12*b*.

In the club head 1 according to the present invention, since the first and second thin part 21 and 22 which can deflect freely when hitting a ball are limited in the particular ranges with respect to the areas A1 and A2, the club head 1 can exert high rebound performance, while maintaining the durability.

According to various sorts of ball hitting tests conducted by the inventor, it was found that there is a tendency that the durability of the club head is decreased when the area A1 of the first thin part 21 becomes less than 10% of the area A of the noncontact portion 12*b*, and that when the area A1 of the first thin part 21 exceeds 35% of the area A of the noncontact portion 12*b*, it becomes difficult to fully improve the rebound performance of the club head.

It was also found that when the area A2 of the second thin part 22 is less than 65% of the area A of the noncontact portion 12*b*, it becomes difficult to fully improve the rebound performance of the club head, and that when the area A2 of the second thin part 22 exceeds 90% of the area A of the noncontact portion 12*b*, there is a tendency that the durability of the club head is decreased.

Preferably, the thickness t1 of the first thin part 21 is set in a range of not less than 1.8 mm, more preferably not less than 2.0 mm, but not more than 3.0 mm, more preferably not more than 2.8 mm.

Preferably, the thickness t2 of the second thin part 22 is set in a range of not less than 1.4 mm, more preferably not less than 1.6 mm, but not more than 2.6 mm, more preferably not more than 2.4 mm.

Preferably, the sole-side first thin part 26 is configured so as include a toe-side region 26*a*, a heel-side region 26*b*, and a middle region 26*c* therebetween in the toe-heel direction, wherein the width Wc of the middle region 26*c* is more than the width Wa of the toe-side region 26*a*, and more than the width Wb of the heel-side region 26*b*.

Here, the widths Wc, Wa and Wb are measured perpendicularly to the length direction of the lower edge 17*b*.

Since an iron-type club head mostly hits a ball put directly on grass, the club head 1 has a high probability of hitting the ball in a sole-side of the face F.

Accordingly, if the second thin part 22 is expanded widely toward the sole, there is a possibility that the durability of the face plate 12 is decreased.

Therefore, by providing the middle region 26*c* having the relatively larger width Wc, the high-restitution-coefficient area can be expanded toward the sole, without sacrificing the durability of the face plate 12.

usual hitting areas of the average golfers range 20 mm from the sweet spot SS to the toe-side and also to the heel-side of the head.

Therefore, it is preferable that the middle region 26*c* ranges 20 mm in the toe-heel direction from its central position corresponding to the sweet spot SS toward the toe and heel in order to effectively increase the durability of the face plate 12.

In order to effectively derive the above advantageous effect, the width Wc of the middle region 26*c* is preferably set in a range of from 3 to 13 mm, the width Wa of the toe-side region 26*a* is preferably set in a range of from 1 to 10 mm, and the width Wb of the heel-side region 26*b* is preferably set in a range of from 1 to 10 mm.

Further, it is preferable that the difference Wc−Wa is set in a range of not less than 2 mm, and the difference Wc−Wb is set in a range of not less than 2 mm.

Thereby, the rebound performance on off-center hits toward the toe or heel can be effectively improved, while the coefficient of restitution measured at the sweet spot SS is limited within a range regulated by the golf rules.

In order to further improve the durability of the face plate 12, it is preferable that the width is smoothly changed in a junction part between the middle region 26*c* and the toe-side region 26*a* and in a junction part between the middle region 26*c* and the heel-side region 26*b*.

Preferably, the top-side first thin part 25 extends in the toe-heel direction while keeping a substantially constant width Wd.

Here, the width Wd is measured perpendicularly to the length direction of the upper edge 17*a*.

The width Wd is preferably set in a range of from 1 to 3 mm.

Preferably, the width Wd is less than the width Wa of the toe-side region 26*a* of the sole-side first thin part 26, and less than the width Wb of the heel-side region 26*b* of the sole-side first thin part 26.

Thereby, the high-restitution-coefficient area of the face F can be significantly expanded toward the top 7.

Further, the lowering of the position of the center G of gravity of the head can be facilitated.

In this embodiment, the toe-side first thin part 27 extends in the up-down direction, while keeping almost constant width We.

Preferably, the width We is set in a range of from 3 to 5 mm.

In general, it is scarce to hit a ball at a position of the face F on the toe-side of the first vertical plane VP1. Therefore, the durability of the face plate 12 can be maintained, even if the toe-side first thin part 27 has not a greater width We.

Figure 6:
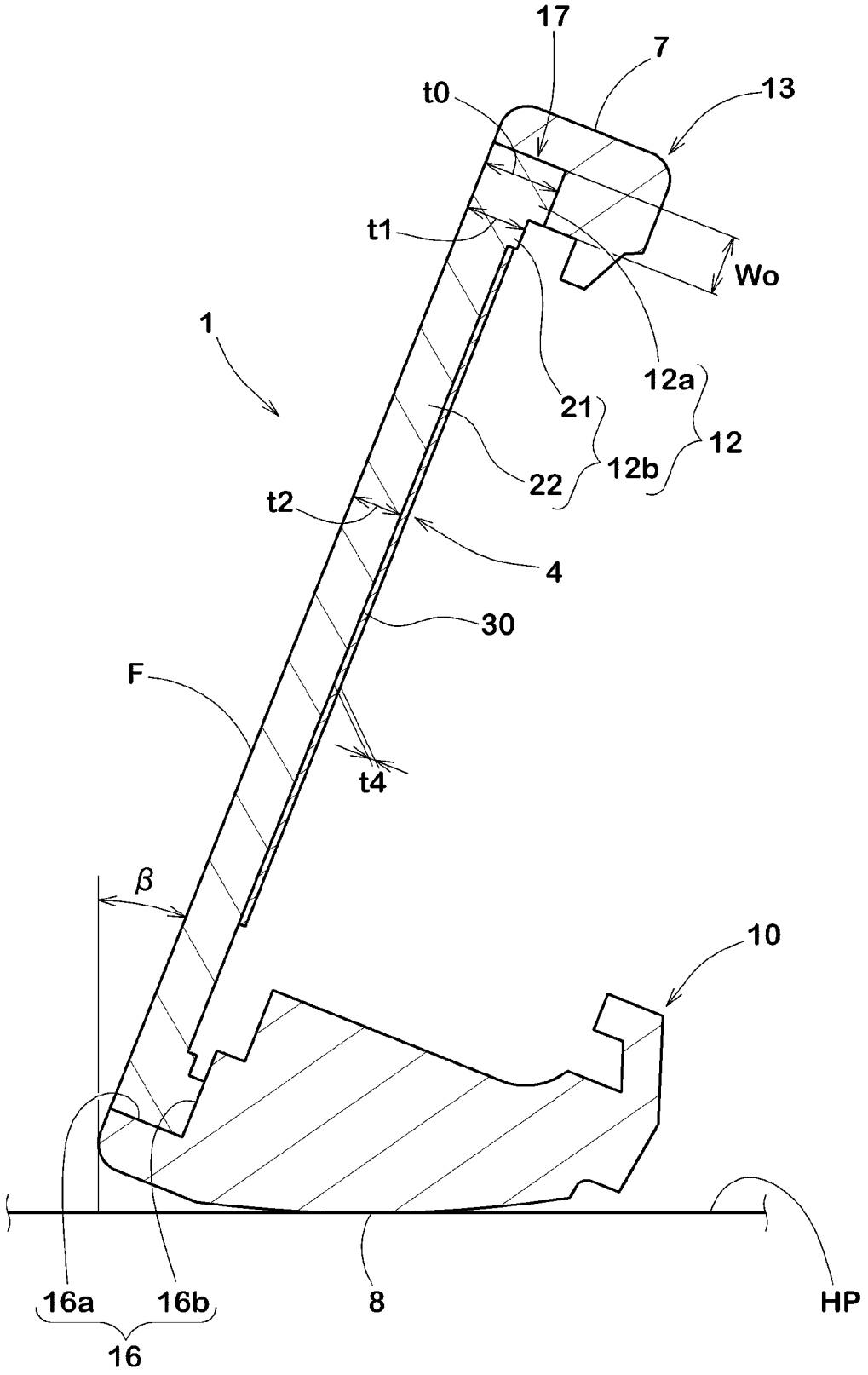
FIG. 6 is a cross sectional view of an iron-type golf club head as a second embodiment of the present invention under its standard state.
Figure 7:
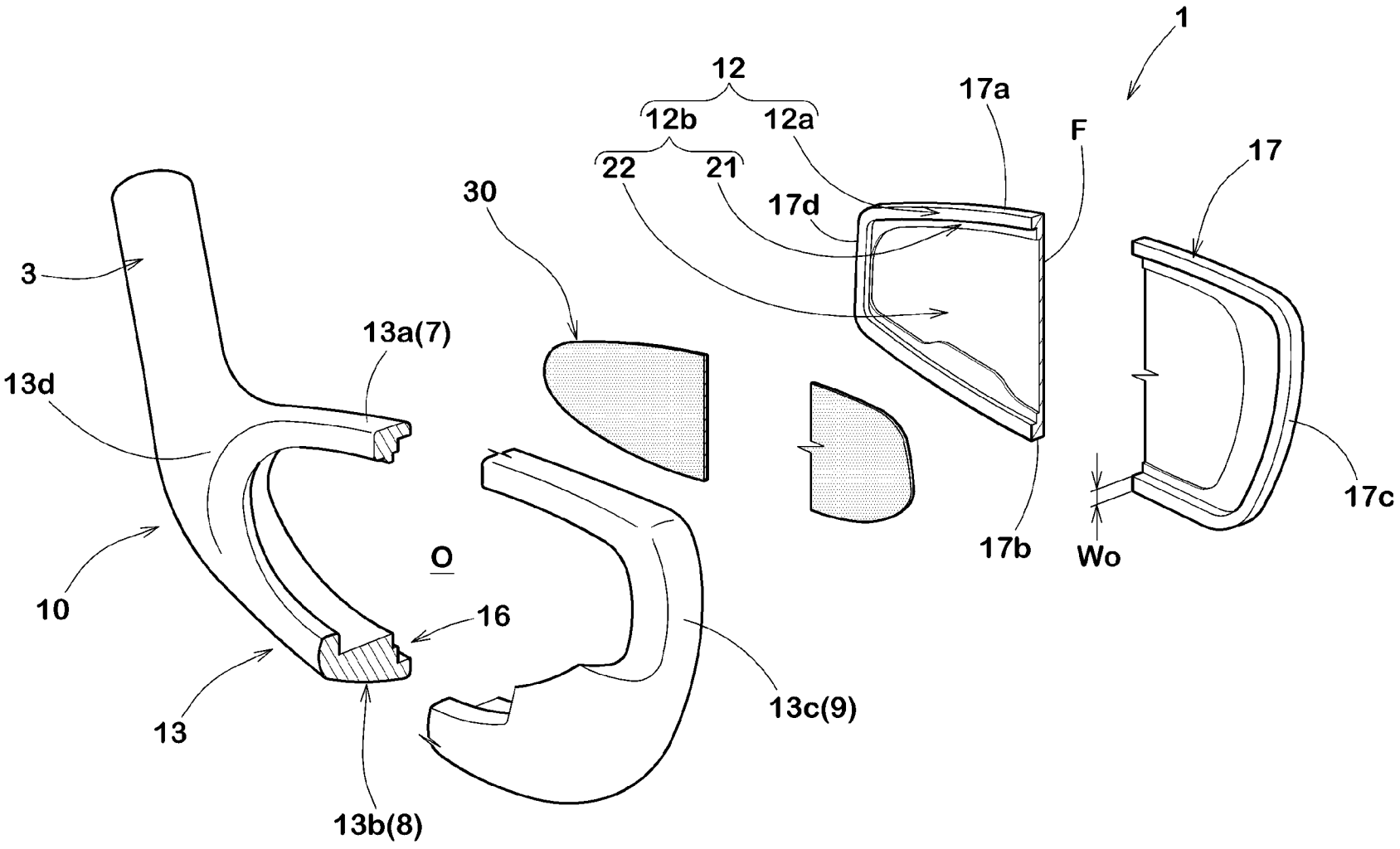
FIG. 7 is an exploded perspective view of the golf club head shown in FIG. 6.
Figure 8:
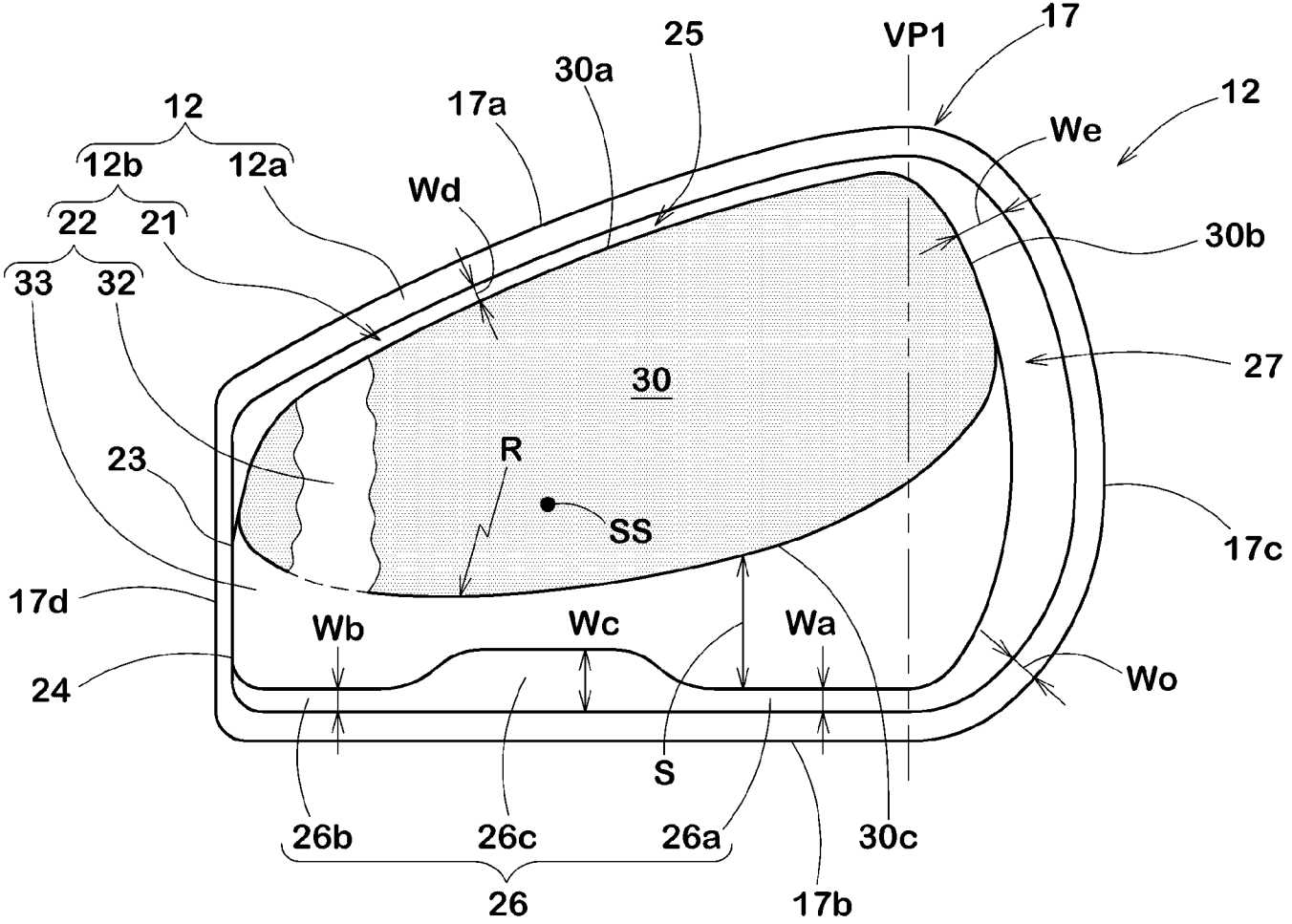
FIG. 8 is a rear view of the face plate in the second embodiment.

FIGS. 6-8 show a further embodiment of the present invention. To avoid redundant explanations, basically, only differences from the former embodiment will be described, otherwise the description of the former embodiment can be applied to this second embodiment, wherein the same reference signs are used for the corresponding parts.

A front view of this second embodiment is the same as that shown in FIG. 1.

FIG. 6 is a cross sectional view of the second embodiment taken along line A-A of FIG. 1.

FIG. 7 is an exploded perspective view of the second embodiment.

FIG. 8 is a rear view of the face plate 12 used in the second embodiment.

In this embodiment, a badge 30 is attached to the back side 4 of the face plate 12. Thereby, the face plate 12 is reinforced from the back side, and the club head 1 is provided with better durability.

The back side of the badge 30 visible through the opening O may be provided with the trade name and/or a logo for the brand name.

The badge 30 is formed from a thin plate which is preferably made of a metal material, for example, aluminum alloy, titanium alloy, stainless steel or the like.

Preferably, the thickness t4 of the badge 30 is set in a range of not less than 0.1 mm, but not more than 0.8 mm, more preferably not more than to 0.5 mm in order to improve the durability of the club head 1 without sacrificing the rebound performance.

If the thickness t4 of the badge 30 is less than 0.1 mm, there is a possibility that the durability of the club head 1 can not be effectively improved. If the thickness t4 of the badge 30 is more than 0.8 mm, there is a possibility that the rebound performance of the club head 1 is deteriorated.

The badge 30 is fixed to only the back surface of the second thin part 22 of the face plate 12 to reinforce the second thin part 22 having the smallest thickness and thereby to effectively increase the durability of the face plate 12.

It is preferable that the badge 30 is fixed by adhesive means, for example, adhesive agent, pressure-sensitive adhesive double coated tape and the like.

The use of such adhesive agent or tackiness agent is advantageous to damp the vibrations of the face plate 12 caused by hitting a ball.

The badge 30 has a top-side edge 30*a* extending along and adjacently to the inner edge of the top-side first thin part 25, a toe-side edge 30*b* extending along and adjacently to the inner edge of the toe-side first thin part 27, and a sole-side edge 30*c* extending on the upper side of the sole-side first thin part 26.

In this example, as shown in FIG. 8, the sole-side edge 30*c* is formed in an arc-like shape being convex to the sole-side and having a radius R of curvature.

The second thin part 22 in the second embodiment is therefore, provided with a reinforced region 32 contacting the badge 30, and a non-reinforced region 33 not contacting the badge 30.

The reinforced region 32 is formed in a top-side of the second thin part 22. The non-reinforced region 33 is formed on the sole-side of the reinforced region 32.

Thus, in the sole-side of the face F, there exists the second thin part 22 with the small thickness, As a result, while expanding the high-restitution-coefficient area toward the sole, the durability of the face plate 12 may be improved.

It is preferable that the size s of the non-reinforced region 33 measured in the up-down direction is gradually increased from its central portion toward the toe and toward the heel. Thereby, the high-restitution-coefficient area of the face F is expanded in the toe-heel direction to further increase the carry distance of the hit ball.

As shown in FIG. 8, in the back view of the face plate 12, the area of the badge 30, namely, the area A3 of the reinforced region 32 is preferably not less than 50%, more preferably not less than 60%, still more preferably not less than 67% of the area A2 of the second thin part 22 in order to enhance the improvement of the durability of the club head 1.

However, in order not to decrease the rebound performance of the club head 1, the area A3 of the reinforced region 32 is not more than 93%, preferably not more than 86%, more preferably not more than 80% of the area A2 of the second thin part 22.

Comparison Tests

Figure 9:
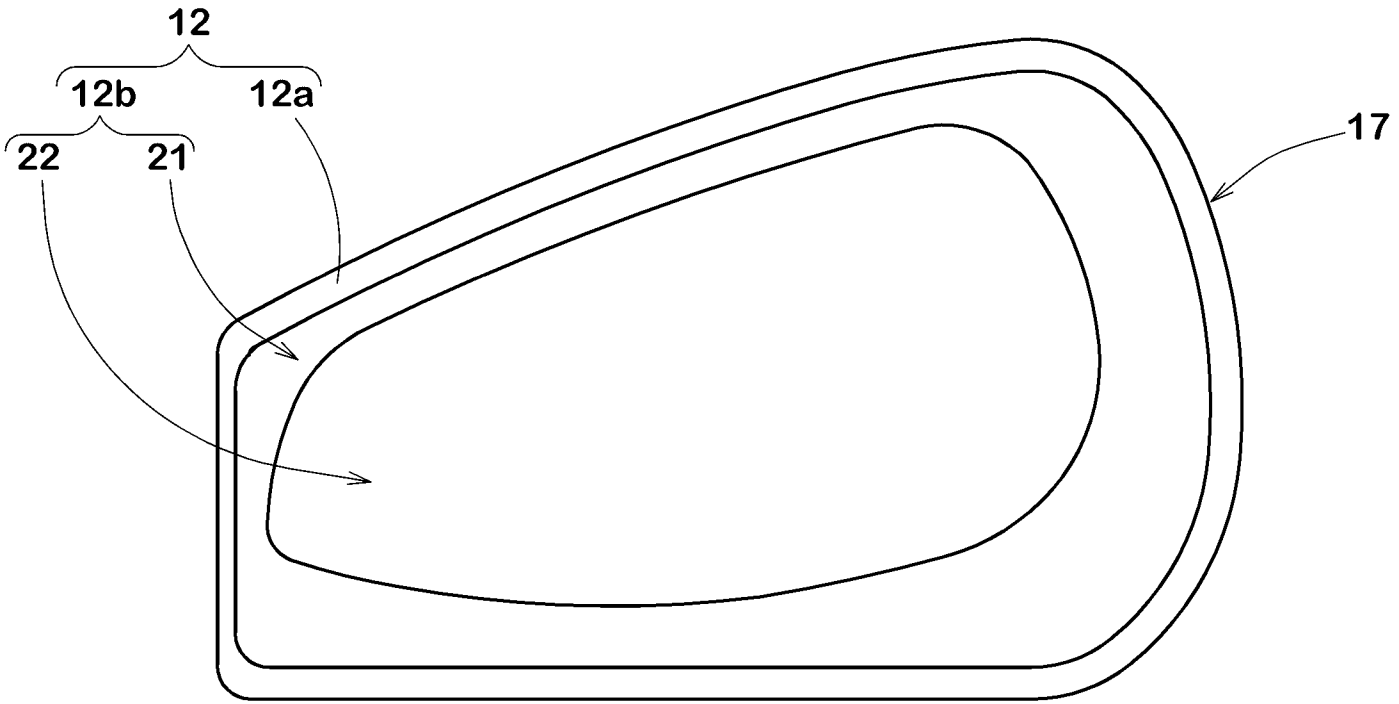
FIG. 9 is a rear view of a face plate of an iron-type golf club head as a comparative example.

Based on the structure shown in FIGS. 1 to 8, golf club heads (E1-E10) for #6 iron according to the present invention were experimentally manufactured, and a golf club head (Ref.) for #6 iron having a face plate show in FIG. 9 was also prepared as a comparative example.

These heads had same specifications except for the face plates. All the face plates had the same contour shape. Specifications of the face plates are shown in Table 1. Specifications common to all of the heads are as follows.

Lie angle: 61.5 degrees

Loft angle: 27 degrees

Head main body 10 face-receiving part 13
material: stainless steel (SUS630)
face plate
material: Ti-5Al-1Fe
outer edge portion 12*a*
width Wo: 2.5 mm
thickness t0: 3.3 mm
noncontact portion
area: 2670 sq.mm
badge
material: 0.3 mm thick stainless steel sheet
fixing: pressure-sensitive adhesive double coated tape The heads were tested for the rebound performance and durability as follows.

<Rebound Performance Test>

According to the "Procedure for Measuring the velocity Ratio of a club Head for conformance to Rule 4-1e, Appendix II, Revision 2 (Feb. 8, 1999), united States Golf Association.", the restitution coefficient was obtained.

The results are indicated in Table 1 by an index based on the comparative example (Ref) being 100, wherein the larger value is better.

<Durability Test>

Each head was attached to a carbon fiber shaft (Dunlop sports Co. Ltd. MP-600, Flex S) to make a 37.5-inch six iron, and the golf club was mounted on a swing robot (Miyamae Co. Ltd.). Then, the head hit golf balls up to 10000 times at the head speed of 42 meter/second, while checking the face plate. If damage or breakage of the face plate was found, the test was stopped and the number of hits was recorded.

The results are indicated in Table 1 by an index based on the comparative example being 100, wherein the larger value is better.

TABLE 1

| Head | Ref | E1 | E2 | E3 | E4 | E5 | E6 | E7 | E8 | E9 | E10 |
|---|---|---|---|---|---|---|---|---|---|---|---|
| area ratio A1/A (%) | 39 | 20 | 10 | 15 | 30 | 35 | 20 | 20 | 20 | 20 | 20 |
| area ratio A2/A (%) | 61 | 80 | 90 | 85 | 70 | 65 | 80 | 80 | 80 | 80 | 80 |
| area ratio A3/A2 (%) | 98 | 76 | 67 | 71 | 86 | 93 | 76 | 76 | 76 | 76 | 76 |
| thickness t1 (mm) | 2.6 | 2.6 | 2.6 | 2.6 | 2.6 | 2.6 | 1.8 | 2.0 | 2.4 | 2.8 | 3.0 |
| thickness t2 (mm) | 2.2 | 2.2 | 2.2 | 2.2 | 2.2 | 2.2 | 1.4 | 1.6 | 2.0 | 2.4 | 2.6 |
| t1-t2 (mm) | 0.4 | 0.4 | 0.4 | 0.4 | 0.4 | 0.4 | 0.4 | 0.4 | 0.4 | 0.4 | 0.4 |
| width Wc (mm) | 5.9 | 6.2 | 3.2 | 5.2 | 11.0 | 13.0 | 6.2 | 6.2 | 6.2 | 6.2 | 6.2 |
| width Wa (mm) | 6.0 | 3.0 | 0.0 | 2.0 | 7.8 | 9.8 | 3.0 | 3.0 | 3.0 | 3.0 | 3.0 |
| width Wb (mm) | 6.5 | 3.0 | 0.0 | 2.0 | 7.8 | 9.8 | 3.0 | 3.0 | 3.0 | 3.0 | 3.0 |
| width Wd (mm) | 2.9 | 1.5 | 1.5 | 1.5 | 1.5 | 1.5 | 1.5 | 1.5 | 1.5 | 1.5 | 1.5 |
| width We (mm) | 7.4 | 4.5 | 4.5 | 4.5 | 4.5 | 4.5 | 4.5 | 4.5 | 4.5 | 4.5 | 4.5 |
| rebound performance | 100 | 106 | 112 | 108 | 103 | 101 | 150 | 140 | 120 | 100 | 90 |
| durability | 100 | 97 | 90 | 95 | 98 | 99 | 75 | 82 | 90 | 105 | 110 |

In the golf club heads (E1-E10), the ratio of the first thin part area A1 and the ratio of the second thin part area A2 were changed by changing the width (Wa, Wb, Wc, Wd, We) of the first thin part 21.

From the test results, it was confirmed that, in comparison with the comparative example, the club heads according to the present invention were significantly improved in the durability and rebound performance.

considering the actual hitting areas of average golfers, the club heads were measured for the restitution coefficient in a region of the face extending about 20 mm upward and downward and toward the toe and heel from the sweet spot SS.

Figure 10:
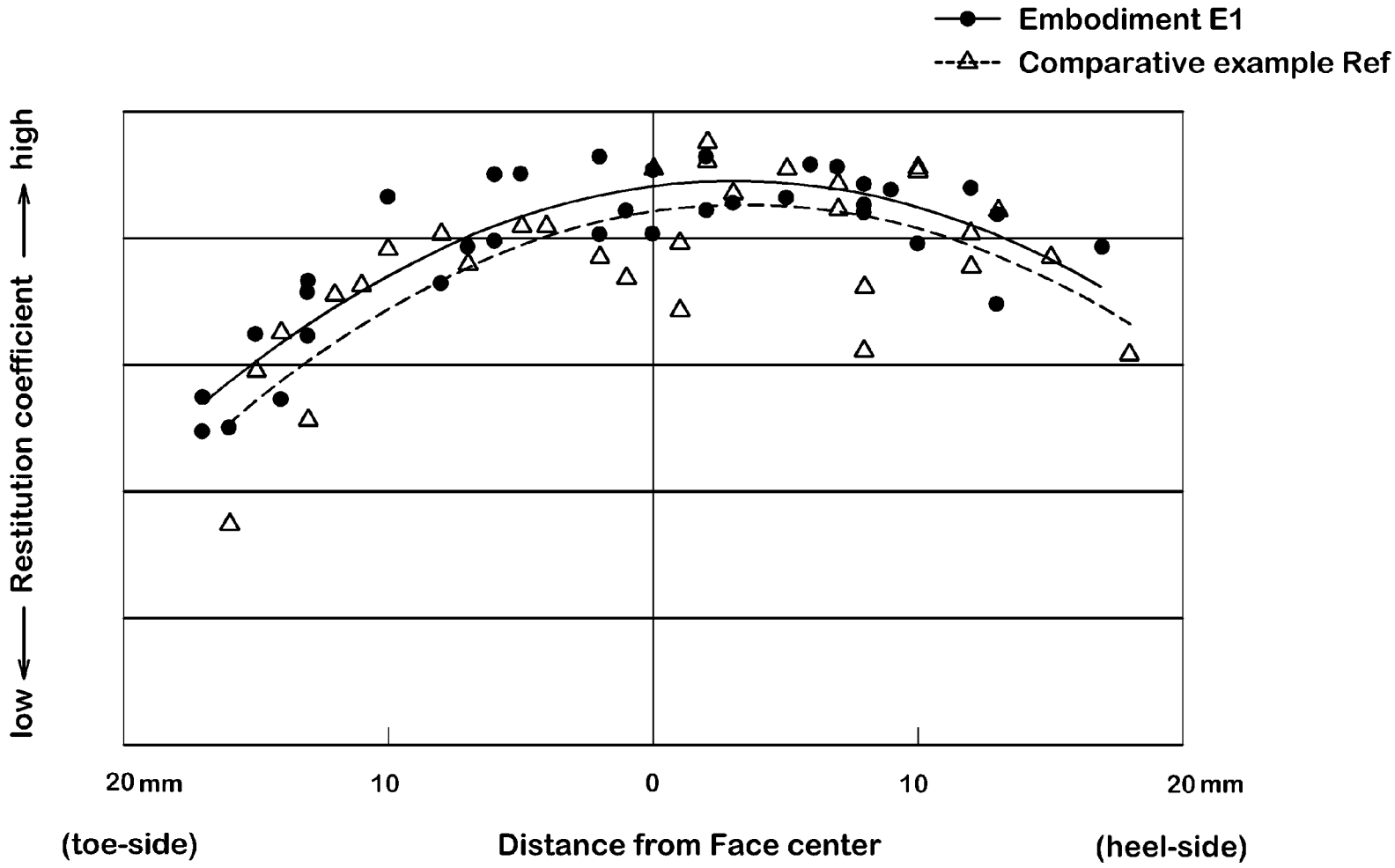
FIG. 10 is a graph showing the restitution coefficient of iron-type golf club heads as an embodiment and a comparative example and the measuring positions in the toe-heel direction.
Figure 11:
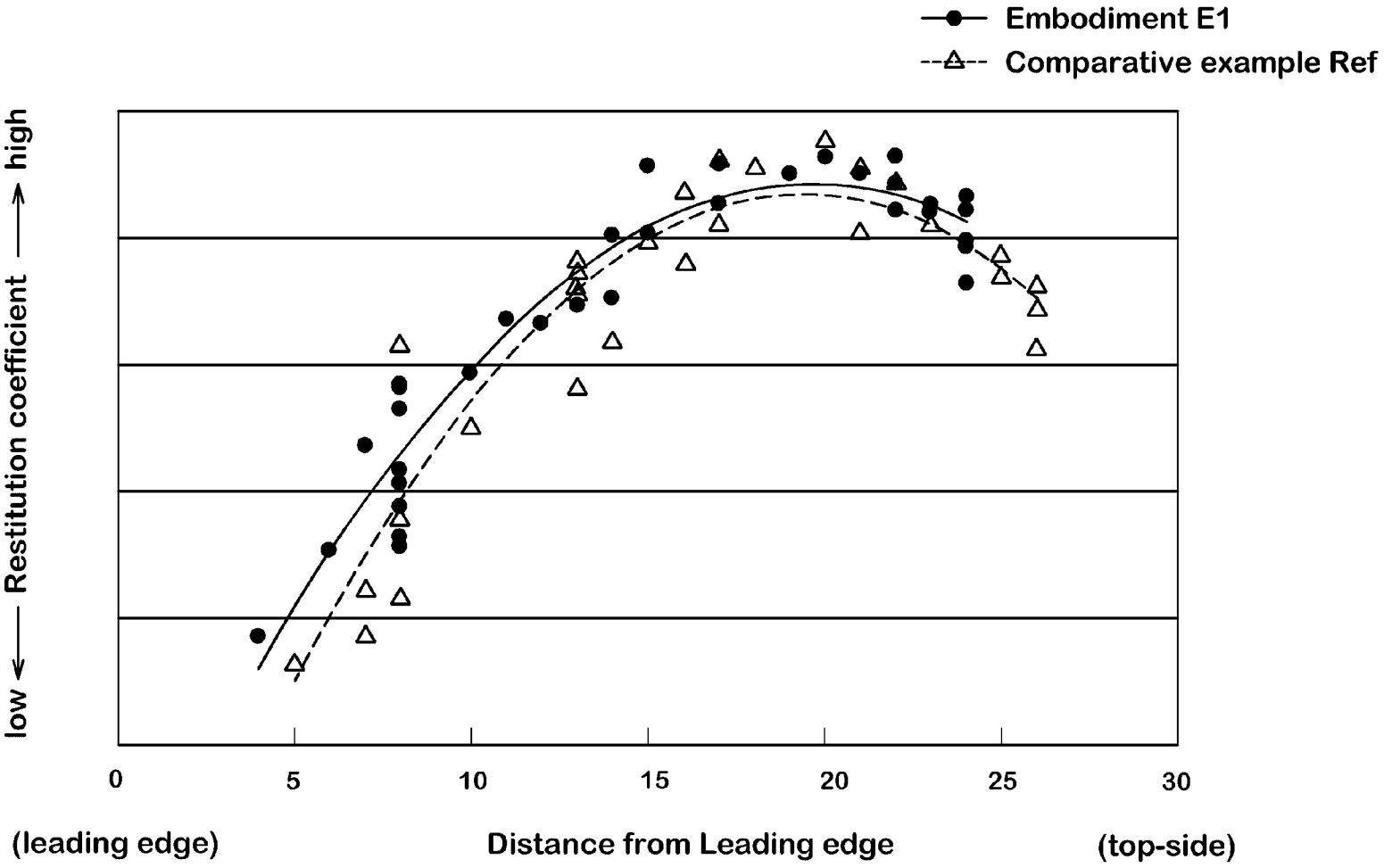
FIG. 11 is a graph showing the restitution coefficient of the iron-type golf club heads and the measuring positions in the up-down direction.

Such measured results of the club heads E1 and Ref are shown in FIGS. 10 and 11.

In FIG. 10, the vertical axis indicates the restitution coefficient, and the horizontal axis indicates the distance in the toe-heel direction from the center of the face.

In FIG. 11, the vertical axis indicates the restitution coefficient, and the horizontal axis indicates the distance in the up-down direction from the leading edge of the face.

In the figures, the restitution coefficient of the club head E1 is plotted by using filled circles, an approximate polynomial curve thereto is indicated by solid line, the restitution coefficient of the club head Ref is plotted by using triangles, and an approximate polynomial curve thereto is indicated by broken line.

As is clear from FIGS. 10 and 11, the restitution coefficient of the club head E1 was improved in a wide range wider in the toe-heel direction and the up-down direction when compared with the club head Ref.

while description has been made of preferable embodiments of the present invention, the illustrated embodiments should not be construed as to limit the scope of the present invention; various modifications are possible without departing from the scope of the present invention.

The invention claimed is:

1. An iron-type golf club head comprising:

a head main body having a top, a sole and a toe surface extending therebetween, and a face plate attached to the head main body and having a front surface for hitting a ball, the face plate defined by its circumferential surface composed of an upper edge extending on the top side, a lower edge extending along the sole, a toe-side edge extending along the toe surface, and a heel-side edge on the opposite side of the toe-side edge, the face plate comprising an annular outer edge portion fixed to the head main body, and a noncontact portion surrounded by the annular outer edge portion and not contacting with the head main body, the noncontact portion comprising a first thin part having a thickness less than that of the annular outer edge portion, and a second thin part having a thickness less than that of the first thin part, the first thin part formed in a peripheral side of the noncontact portion so as to extend along at least the upper edge, the toe-side edge and the lower edge of the circumferential surface of the face plate, wherein the area of the first thin part is 10% to 35% of the area of the noncontact portion, and the second thin part formed on the inner side of the first thin part, wherein the area of the second thin part is 65% to 90% of the area of the noncontact portion, wherein the first thin part includes a sole-side first thin part extending along the above-mentioned lower edge, and the sole-side first thin part comprises a toe-side region, a heel-side region and a middle region therebetween such that the width of the middle region is more than the width of the toe-side region and more than the width of the heel-side region, each width measured perpendicularly to the longitudinal direction of the lower edge.

2. The iron-type golf club head according to claim 1, wherein the thickness of the first thin part is 1.8 to 3.0 mm, and the thickness of the second thin part is 1.4 to 2.6 mm.

3. The iron-type golf club head according to claim 1, wherein the area of the first thin part is 15% to 30% of the area of the noncontact portion, and the area of the second thin part is 70% to 85% of the area of the noncontact portion.

4. The iron-type golf club head according to claim 2, wherein the area of the first thin part is 15% to 30% of the area of the noncontact portion, and the area of the second thin part is 70% to 85% of the area of the noncontact portion.

5. The iron-type golf club head according to claim 1, wherein the thickness of the first thin part is 2.0 to 2.8 mm, and the thickness of the second thin part is 1.6 to 2.4 mm.

6. The iron-type golf club head according to claim 1, wherein the above-mentioned middle region of the sole-side first thin part is disposed in a region ranging 20 mm from the sweet spot of the face toward the toe-side and also toward the heel-side of the sweet spot.

7. The iron-type golf club head according to claim 1, wherein the width of the middle region is 3 to 13 mm, the width of the toe-side region is 1 to 10 mm, the width of the heel-side region is 1 to 10 mm, the difference between the width of the middle region and the width of the toe-side region is not less than 2 mm, and the difference between the width of the middle region and the width of the heel-side region is not less than 2 mm.

8. An iron-type golf club head comprising:

a head main body having a top, a sole and a toe surface extending therebetween, and a face plate attached to the head main body and having a front surface for hitting a ball, wherein the face plate is defined by its circumferential surface composed of an upper edge extending on the top side, a lower edge extending along the sole, a toe-side edge extending along the toe surface, and a heel-side edge on the opposite side of the toe-side edge, wherein the face plate comprises:

an annular outer edge portion fixed to the head main body, and a noncontact portion surrounded by the annular outer edge portion and not contacting with the head main body, wherein the noncontact portion comprises:

a first thin part having a thickness less than that of the annular outer edge portion, and a second thin part having a thickness less than that of the first thin part, wherein the first thin part is formed in a peripheral side of the noncontact portion so as to extend along at least the upper edge, the toe-side edge and the lower edge of the circumferential surface of the face plate, wherein the area of the first thin part is 10% to 35% of the area of the noncontact portion, and the second thin part formed on the inner side of the first thin part, wherein the area of the second thin part is 65% to 90% of the area of the noncontact portion, wherein the face plate is provided in the second thin part with a badge made of a thin plate fixed to the back surface of the face plate, and the area of the badge is not more than 93% of the area of the second thin part, wherein the second thin part is composed of a reinforced region to which the badge is attached, and a non-reinforced region to which the badge is not attached and which is positioned on the sole-side of the reinforced region, and wherein the size of the non-reinforced region measured in the up-down direction becomes larger on the toe-side and the heel-side of a central portion of the non-reinforced region in the toe-heel direction than in the central portion.

9. The iron-type golf club head according to claim 8, wherein the badge is made of a metal sheet having a thickness of 0.1 to 0.8 mm.

* * * * *